US008007198B1

(12) United States Patent
La Valley et al.

(10) Patent No.: US 8,007,198 B1
(45) Date of Patent: Aug. 30, 2011

(54) ARRESTING SYSTEMS AND METHODS

(75) Inventors: Brad M. La Valley, Brookhaven, PA (US); William Horan, Springfield, PA (US)

(73) Assignee: Engineered Arresting Systems Corporation, Aston, PA (US)

( * ) Notice: Subject to any disclaimer, the term of this patent is extended or adjusted under 35 U.S.C. 154(b) by 0 days.

(21) Appl. No.: 12/715,471

(22) Filed: Mar. 2, 2010

(51) Int. Cl.
*E01F 13/12* (2006.01)
*E01F 15/06* (2006.01)

(52) U.S. Cl. ..... 404/6; 256/13.1

(58) Field of Classification Search ..... 404/6, 9; 256/13.1
See application file for complete search history.

(56) References Cited

U.S. PATENT DOCUMENTS

| | | | | |
|---|---|---|---|---|
| 5,245,787 | A * | 9/1993 | Swenson et al. | 49/34 |
| 6,062,765 | A * | 5/2000 | Dotson | 404/6 |
| 6,779,756 | B1 | 8/2004 | Lopez | |
| 6,843,613 | B2 | 1/2005 | Gelfand et al. | |
| 6,962,245 | B2 * | 11/2005 | Ray et al. | 188/377 |
| 7,467,909 | B2 * | 12/2008 | Orner et al. | 404/6 |
| 2006/0045618 | A1 * | 3/2006 | Bibber | 404/6 |
| 2006/0140718 | A1 * | 6/2006 | Lamore | 404/6 |
| 2007/0140791 | A1 * | 6/2007 | Gelfand | 404/6 |
| 2008/0213042 | A1 * | 9/2008 | Metzger | 404/6 |

* cited by examiner

*Primary Examiner* — Raymond Addie
(74) *Attorney, Agent, or Firm* — Dean W. Russell; Kilpatrick Townsend & Stockton LLP

(57) ABSTRACT

Systems and methods for arresting vehicles or other moving objects are detailed. The systems may be bi-directional, so as to arrest vehicles on either side of a barrier. They additionally may be reset for reuse relatively rapidly following deployment and comprise mechanical controllers for facilitating suitable deformation of the barriers. Modular slotted beams also may be employed to accommodating differing widths and crowns of roadways.

14 Claims, 11 Drawing Sheets

ARRESTING SYSTEMS AND METHODS

FIELD OF THE INVENTION

This invention relates to systems and methods for impeding movement of moving objects and more particularly, although not necessarily exclusively, to bidirectional, reusable systems and methods for arresting travel of ground-based (or other) vehicles.

BACKGROUND OF THE INVENTION

U.S. Pat. No. 6,843,613 to Gelfand, et al. discloses an energy absorbing system forming part of an automobile barrier for placement preferably at a railroad crossing. The system includes a net stored in a pit spanning a roadway and parallel to railroad tracks. The net may be raised as an automobile approaches along the roadway in a particular travel direction; should the automobile not stop timely it will collide with the net, causing the automobile to cease travel prior to reaching the tracks.

The system of the Gelfand patent also contemplates placing a second automobile barrier opposite the railroad tracks from the first barrier. Such a two-barrier system is depicted especially in FIGS. 1A-1B of the Gelfand patent, with one net impeding automobile travel in a first direction along the roadway and the other net impeding travel in the direction opposite the first direction. In this sense each barrier of the Gelfand patent is only uni-directional, as the structure used to absorb energy functions only when the net is displaced toward the railroad tracks.

U.S. Pat. No. 6,779,756 to Lopez, owned commonly with this application, describes other systems for arresting aircraft or other vehicles. Designed typically for above-ground installation, these systems include dual arresting tapes provided on spools with brake assemblies positioned within hubs of the spools. The arresting tapes are designed for connection to a cable crossing a runway (or other travel area), with the cable being engaged typically by a tail hook associated with the vehicle to be arrested. For purposes of this application, the entire contents of both the Lopez and Gelfand patents are incorporated herein by this reference.

SUMMARY OF THE INVENTION

The present invention provides alternate systems and methods for arresting, or otherwise impeding, movement of objects such as vehicles. Systems of the invention may be bi-directional in operation and may be reset for reuse relatively rapidly after having been deployed. Such systems additionally may use some or substantially all of available stopping space when deployed, potentially reducing likelihood of injury to occupants of arrested vehicles.

Present systems preferably use a net as a barrier to travel. They additionally may include brake-in-spool assemblies and arresting tapes similar to those of the commonly-owned Lopez patent. In one version of the invention, retractable stanchions raise and lower the net from a laterally-slotted beam embedded in a roadway (or similar) surface. When undeployed, therefore, the net is typically positioned below grade. However, in another version of the invention the net rests above ground and is lowered from its resting position when deployed. In either version, sheave rollers may be included to permit bi-directional use of the systems.

Thus, at least some embodiments of the invention may comprise a pair of energy absorbers, in the form of brake assemblies, positioned at opposite sides of a roadway, runway, or other to-be-travelled surface. The assemblies may include tape reels, with associated tapes indirectly connected to each end of a net via a tape connector. Cooperating stanchions at each end of the net operate to raise or lower the net as needed, and sheave rollers through which the tapes pass rotate suitably to impede motion of the object engaging the net.

Versions of the invention additionally may include mechanical net deployment controllers. Designed to facilitate wrapping of the net around the nose of the vehicle to be arrested, the controllers assist in maintaining tension on corners of the net as the net engages the vehicle. Upon such engagement, forces acting on the controllers cause shear pins to fail, releasing portions of the controllers to remain attached to the net and allowing tape to pay out with the net via friction pins. Other portions of the controllers may fall to the ground under force of gravity, out of the path of the pay-out tape. The controllers are especially (although not necessarily exclusively) useful during the "transition zone" of the arrestment; i.e. the portion of arrestment from initial contact of the net by the vehicle until full actuation of energy absorber braking.

Laterally-slotted beams of the invention may, if desired, be comprised of multiple sections made preferably (although not necessarily) of pre-cast concrete. Using multiple sections allows the beam to accommodate differing road widths, with fewer or more sections being utilized as appropriate for a particular width. The multiple sections also may accommodate greater variety of roadway crowns or other deviations of the roadway from horizontal. Upper surfaces of terminal beam sections may be angled for tape sweep clearance, while any or all sections may incorporate internal conduit or other piping to drain rainwater or other liquids otherwise accumulating in the slots.

It thus is an optional, non-exclusive object of the present invention to provide systems and methods of absorbing energy so as to slow a moving object.

It is also an optional, non-exclusive object of the present invention to provide systems and methods of impeding movement of a vehicle or other object occupied by humans.

It is an additional optional, non-exclusive object of the present invention to provide systems of arresting vehicles, which systems may operate regardless of direction of travel of the vehicles along roadways.

It is another optional, non-exclusive object of the present invention to provide systems of arresting vehicles, which systems may be reset and reused.

It is a further optional, non-exclusive object of the present invention to provide systems and methods of arresting vehicles employing nets that may be either raised or lowered for deployment.

It is, moreover, an optional, non-exclusive object of the present invention to provide systems and methods of arresting vehicles utilizing friction brakes in connection with the nets.

It is yet another optional, non-exclusive object of the present invention to provide systems and methods of arresting vehicles in which mechanical controllers assist in maintaining tension on corners of the nets as the nets engage the vehicles.

It is additionally an optional, non-exclusive object of the present invention to provide systems and methods of arresting vehicles in which multiple sections or modules may be used to form the laterally-slotted beams in which nets normally reside.

It is, furthermore, an optional, non-exclusive object of the present invention to provide systems and methods of arresting vehicles in which some or all beam sections may incorporate means for drain rainwater or other liquids otherwise accumulating in the slots.

Other objects, features, and advantages of the present invention will be apparent to those skilled in the relevant art with reference to the remaining text and drawings of this application.

DETAILED DESCRIPTION

Figure 1:
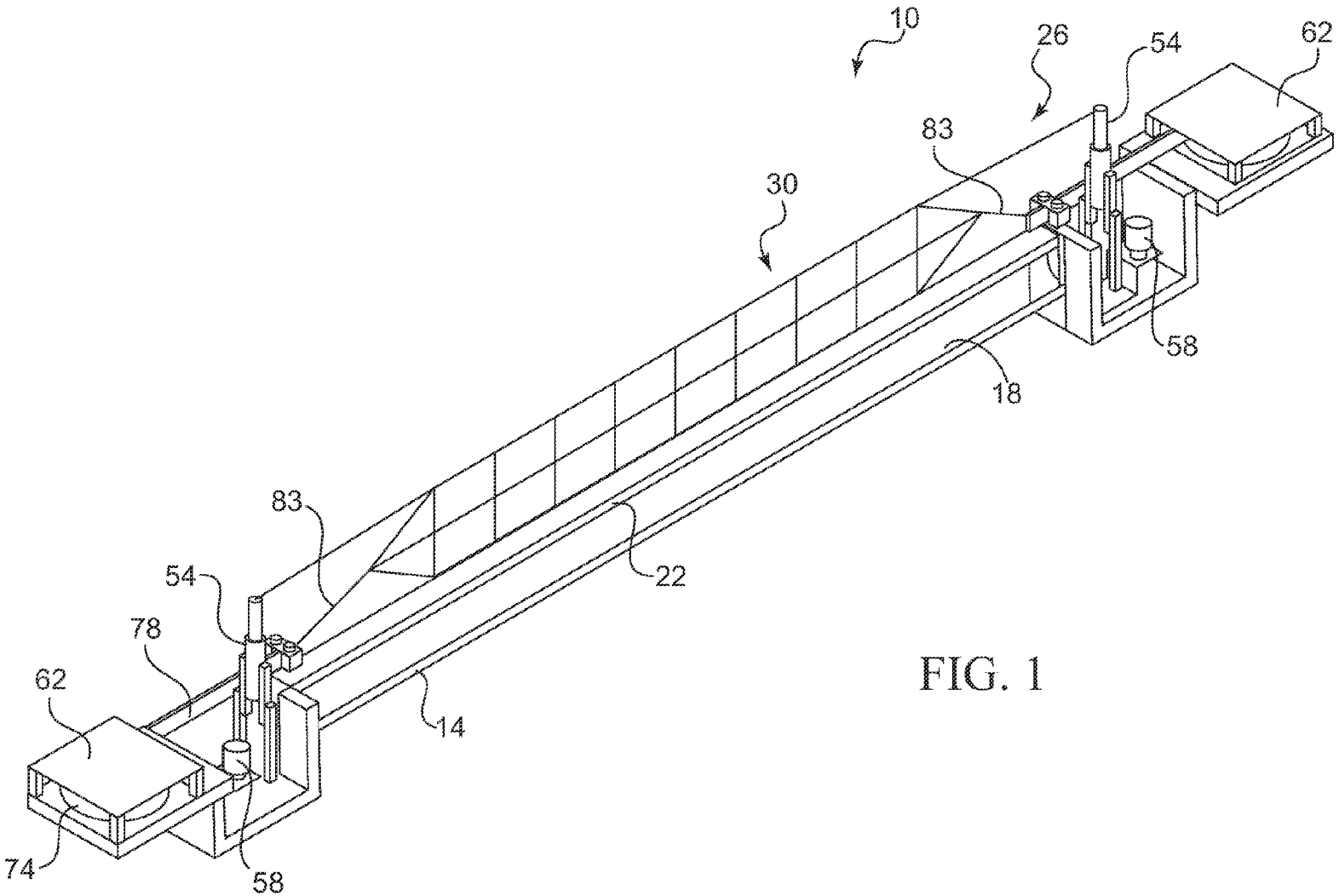
FIG. 1 is a cut-away, partially schematicized view of an in-ground version of a system of the present invention.
Figure 2A:
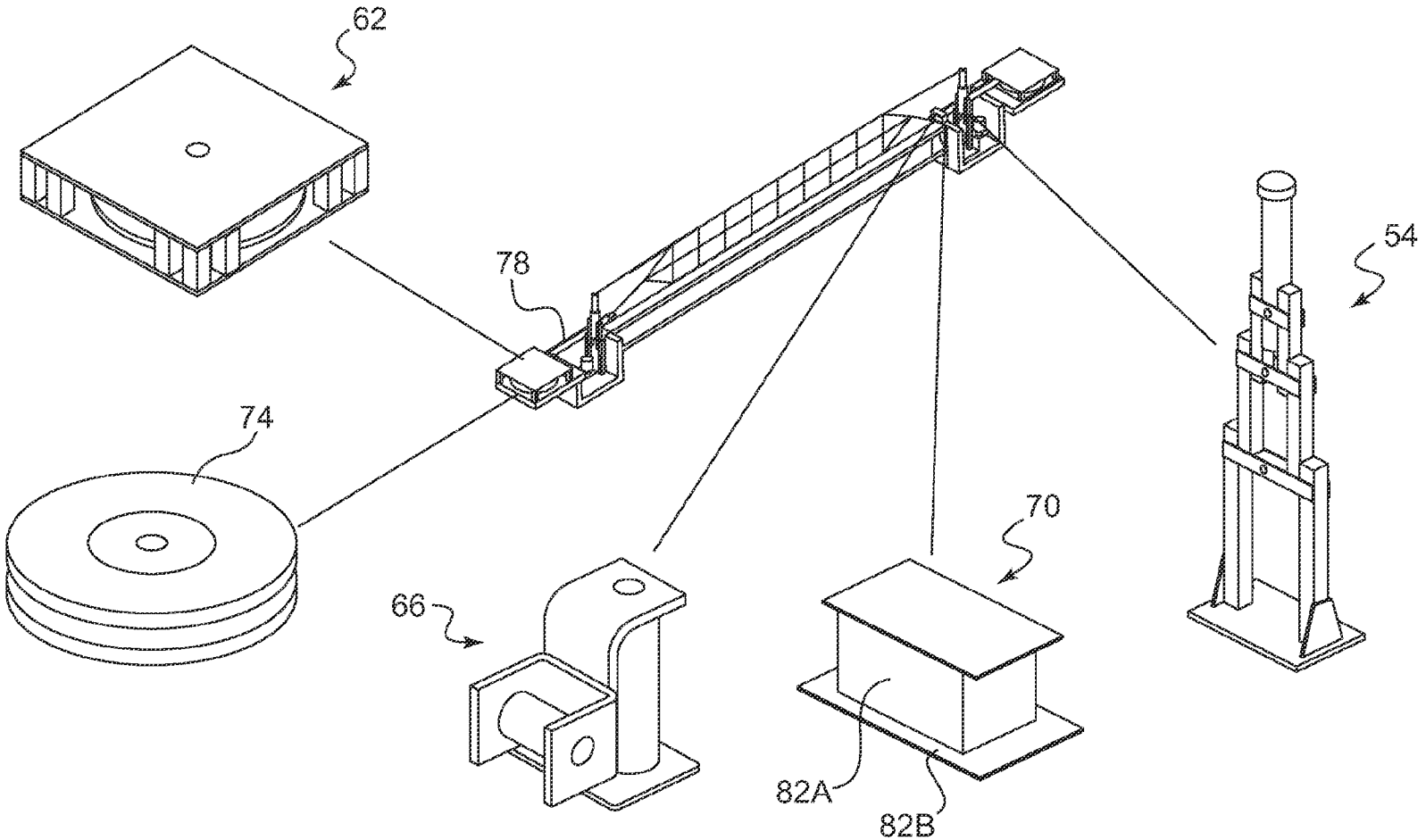
FIGS. 2A-B are another view of the system of FIG. 1 with selected components enlarged, with FIG. 2A depicting the system as deployed and FIG. 2B detailing the undeployed system.
Figure 2B:
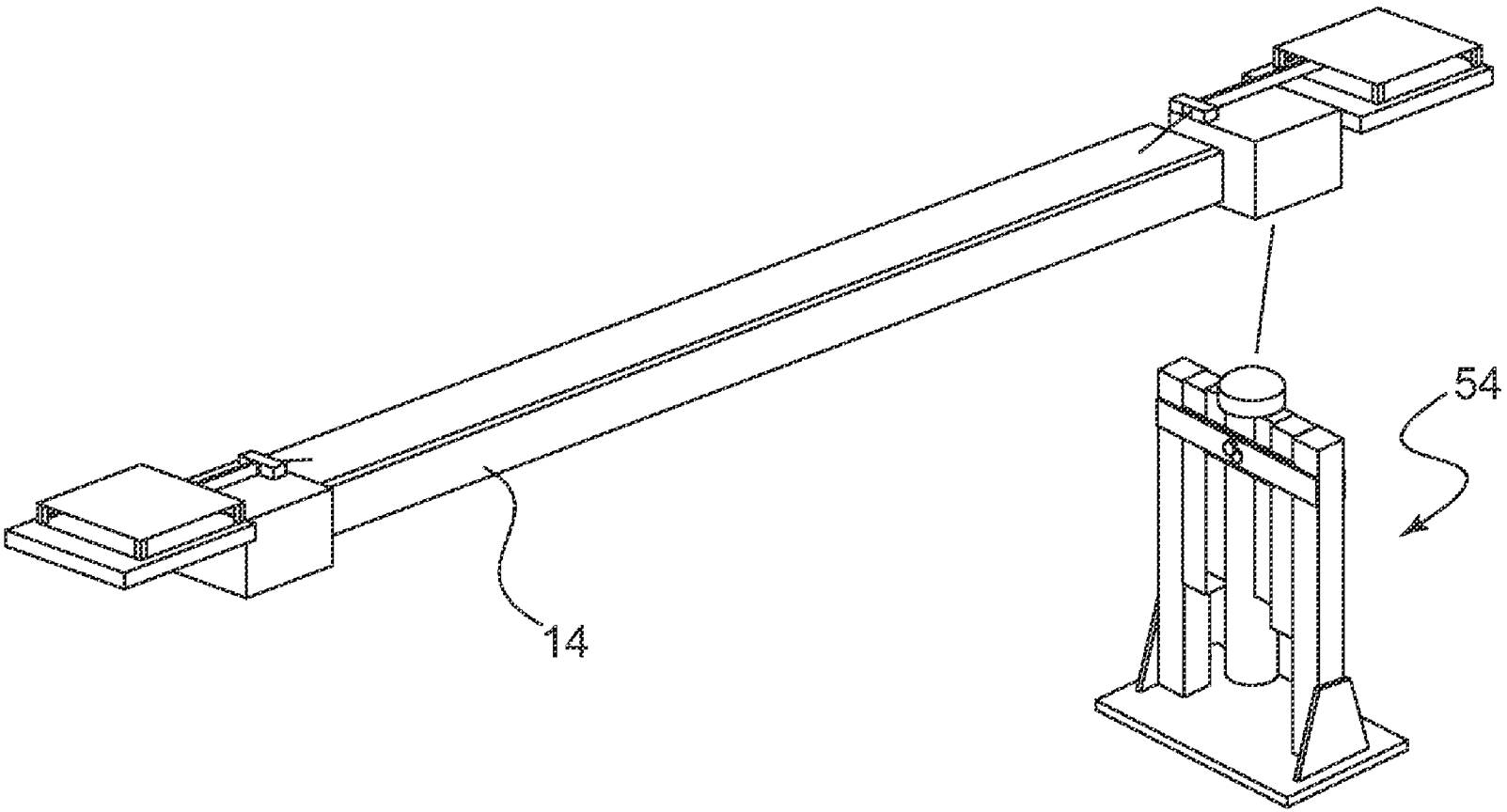

Depicted in FIGS. 1 and 2A-B is exemplary system 10 of the present invention. System 10 is denoted "in-ground" because many of its components are below grade (at least prior to deployment). Those skilled in the relevant field will recognize that not all components of system 10 need necessarily be below grade prior to deployment, so system 10 may be constructed differently than as shown in FIGS. 1 and 2A-C.

Nevertheless, system 10 preferably includes module 14, which beneficially may be a pre-cast block or beam of concrete. Module 14 typically will be elongated, with a length greater than the width of the roadway, runway, or other travel surface with which it is deployed. When positioned across such travel surface, therefore, module 14 will span its width.

Module 14 additionally is designed to be embedded in the travel surface with its upper surface 18 flush therewith. Upper surface 18 itself thus may form part of the travel surface. Accordingly, module 10 should be of sufficient strength to bear loads consistent with vehicular traffic to which it will be exposed.

Preferably included within module 14 is a longitudinally-extending slot 22 that likewise spans the width of the travel surface with which it is deployed. Positioned within slot 22 may be an arrestor assembly 26 comprising, among other items, net 30. Net 30 may be made of natural or synthetic fabric (or both) or of any other material capable of withstanding contact with a moving vehicle while tensioned consistent with the invention.

Figure 4:
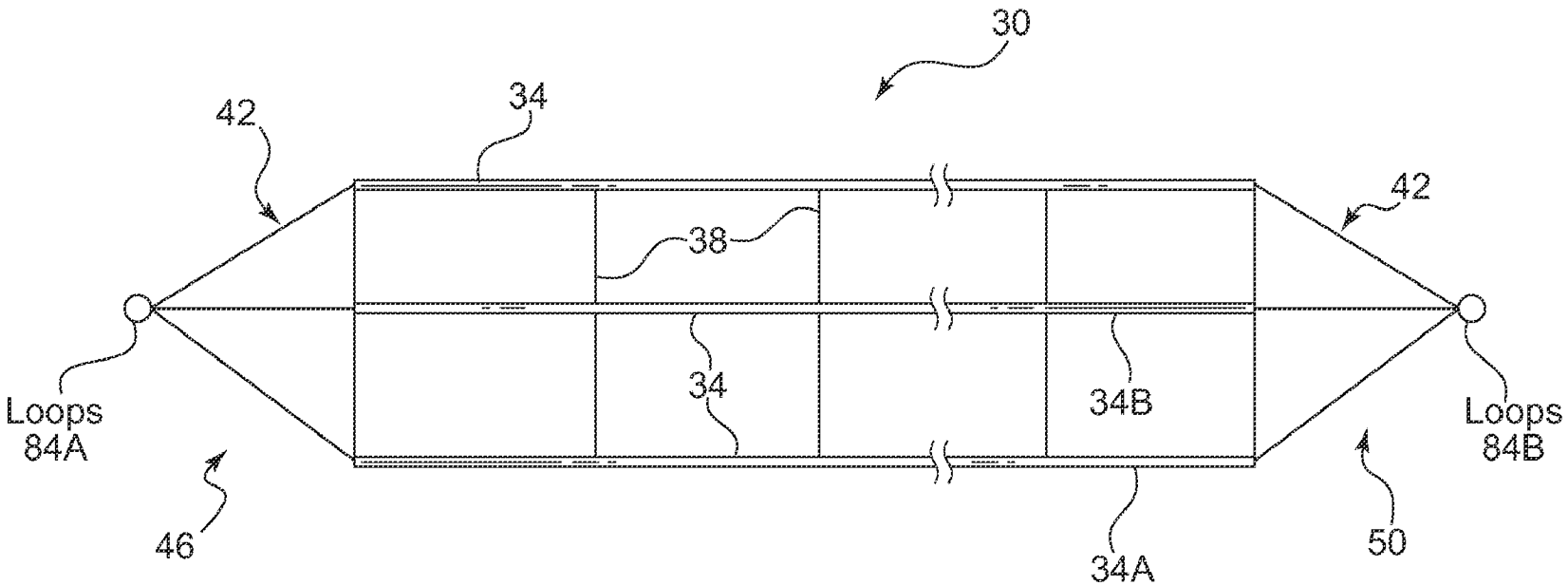
FIG. 4 is a plan view of a net useful as part of the systems of FIGS. 1-3B.

FIG. 4 depicts an exemplary configuration of net 30, with three spaced, generally-horizontal beams 34, a selected number of spaced, generally-vertical beams 38 as required for the width of the travel surface, and triangular sections 42 forming ends 46 and 50. Preferred versions of net 30 are made of synthetic fiber. However, those skilled in the art will understand that net 30 may be constructed other than as depicted and described herein.

Also included as part of arrestor assembly 26 may be stanchions 54. Each of a pair of stanchions 54 may be positioned adjacent an end 46 or 50 of net 30. Stanchions 54 function to raise net 30 out of slot 22 (i.e. above the travel surface) for deployment as shown in FIGS. 1 and 2A. They also serve to lower net 30 into slot 22 (i.e. below the travel surface) when not in use—as shown in FIG. 2B.

Preferred versions of stanchions 54 are electrically operated using motors 58. Stanchions 54 may be operated manually or otherwise as desired, however. In areas subject to low temperatures, heaters may be included as part of arrestor assembly 26 so as to facilitate operation of motors 58 and corresponding stanchions 54.

FIGS. 1 and 2A-B illustrate additional components of system 10. Such components may include brake assemblies 62, tape connectors 66, and sheave rollers 70, all of which preferably are (but need not necessarily be) located above grade. Advantageously one brake assembly 62, connector 66, and sheave roller 70 is associated with each end 46 and 50 of net 30 so that two of each component are included within system 10. Conceivably, however, more than two of each component may be employed if appropriate to do so.

Incorporated into each brake assembly 62 may be (at least one) reel 74 containing (at least one) tape 78. Reels 74 normally are oriented generally horizontally, so that they rotate about generally vertically-oriented axes. Assembly 62 may be constructed and operate generally as detailed in the Lopez patent: When a vehicle contacts and deforms deployed net 30, each tape 78 may unwind from its reel 74 while a brake within assembly 62 exerts force on the reel 74. Tapes 78 thus help absorb energy caused by the vehicle dynamically loading net 30. Although tapes 78 may unspool to any extent necessary to effect the purposes of system 10, applicants believe lower-weight passenger automobiles frequently may be stopped within approximately thirty-five feet of run-out of each tape 78 and heavy passenger vehicles stopped with as little as one hundred feet of run-out of tapes 78. Brake assemblies 62 alternatively may be royalty hydraulic brakes such as those provided by Engineered Arresting Systems Corporation of Aston, Pa. under, e.g., the name "Water Twister."

Tapes 78 connect to respective ends 46 and 50 of net 30 via connectors 66 and sheave rollers 70. Threading tape 78 through sheave rollers 70 permits it to bear against (and therefore cause to rotate) either roller 82A or roller 82B, depending on the direction the to-be-arrested vehicle is moving relative to net 30. Connections preferably occur at loops 84A and 84A at respective ends 46 and 50, with cable, rope, or similar material 83 connecting the loops 84A and 84B to tape connectors 66. Such material 83 may be separate from beams 34 or a continuation of one or more of such beams 34.

Slot 22 preferably is approximately two inches wide, while tape 78 preferably is six inches wide and made of nylon or polyester. Again, however, neither width is critical. Instead, either or both of slot 22 and tape 78 may have different measurements if desired, and tape 78 may be made of other materials.

Optionally included as part of system 10 may be shear links designed to connect beams 34 to stanchions 54 and maintain the beams 34 under additional tension. These links may release under the stress of vehicle engagement, in which event their replacement would be required before system 10 is reused. Tapes 78 further are designed to be rewindable onto reels 74 post-use, so that system 10 may be reused without replacement of the tapes 78. Finally, a cover may be employed over slot 22 to reduce foreign objects from entering the slot 22, as long as the cover does not impede deployment of net 30.

Figure 3B:
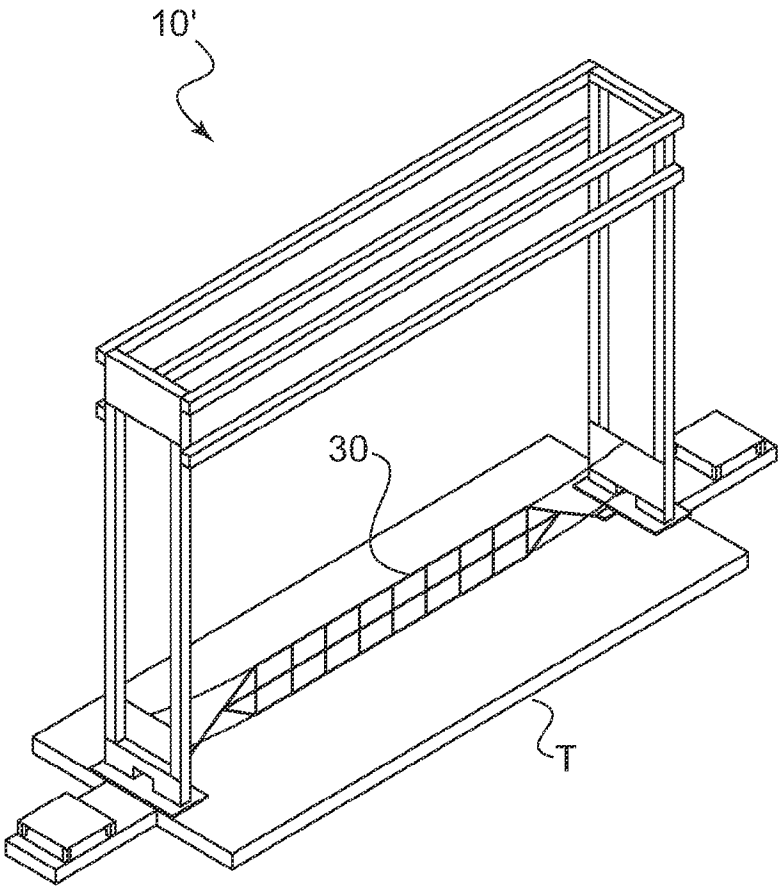
FIGS. 3A-B are views of an above-ground version of a system of the present invention, with FIG. 3A illustrating the system prior to deployment and FIG. 3B illustrating the deployed system.
Figure 3A:
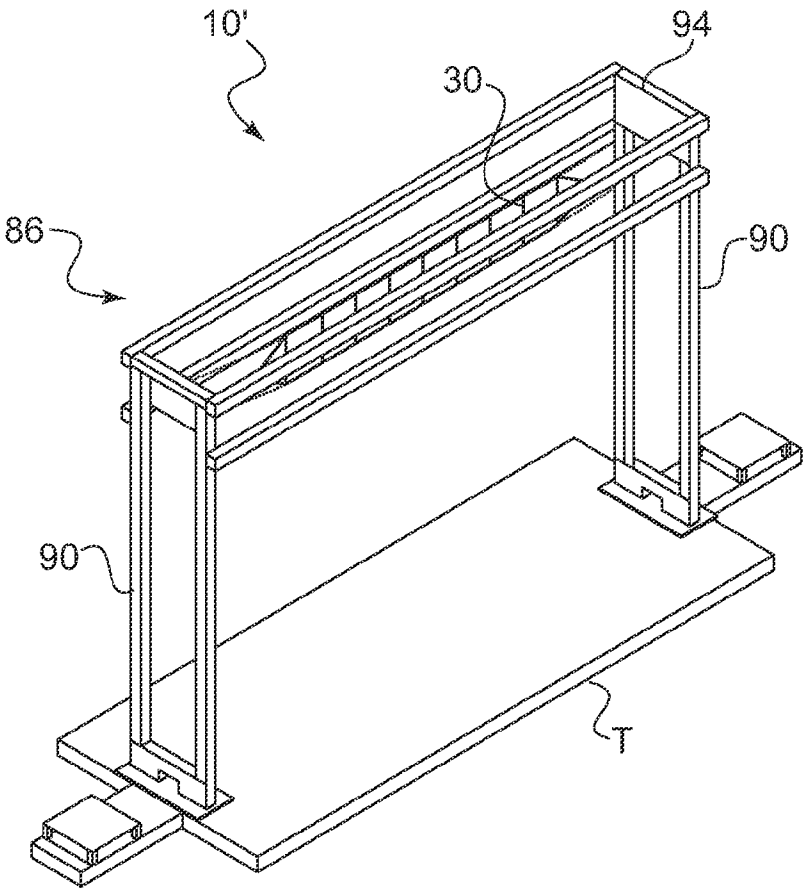

FIGS. 3A-B illustrate an alternative system 10' of the present invention. Components of system 10' are located above grade, so that the system 10' may be denoted an "above-ground" version of the invention. Rather than including slot 22 in which net 30 rests between deployments, system 10' includes superstructure or frame 86 extending above grade. Frame 86 includes opposed legs 90 to either side of travel surface T and between which net 30 extends. Net 30 normally is retracted at the top 94 of frame 86, well above the travel surface as shown in FIG. 3A. For deployment, net 30 may travel down legs 90 so as to be adjacent travel surface T (as illustrated in FIG. 3B). Preferably tapes 78 do not connect to net 30 until the net 30 is positioned as shown in FIG. 3B, likely requiring use of quick-connect/disconnect fasteners as part of system 10'.

Sensors associated with the travel surface may provide signals actuating either system 10 or system 10'. Should sensors for system 10 indicate that a travelling object should be arrested, system 10 would activate, with motors 58 causing stanchions 54 to expand. Such expansion of stanchions 54 in turn raises net 30 above the travel surface, thereby placing net 30 in the path of the to-be-arrested object. In certain embodiments of the invention the act of raising net 30 requires only two to three seconds, although faster or slower rise times may occur as appropriate. Further, net 30 need not be fully raised to function as an arrestor, as raising only a portion of net 30 above grade may be sufficient to arrest some vehicles and other objects.

Activation of system 10' is generally similar. If associated sensors indicate need to arrest an object traveling toward system 10', net 30 is lowered along legs 90 into position adjacent travel surface T and connected to tapes 78. These actions preferably require only three to five seconds, although again shorter or longer lowering times may occur.

Figure 5:
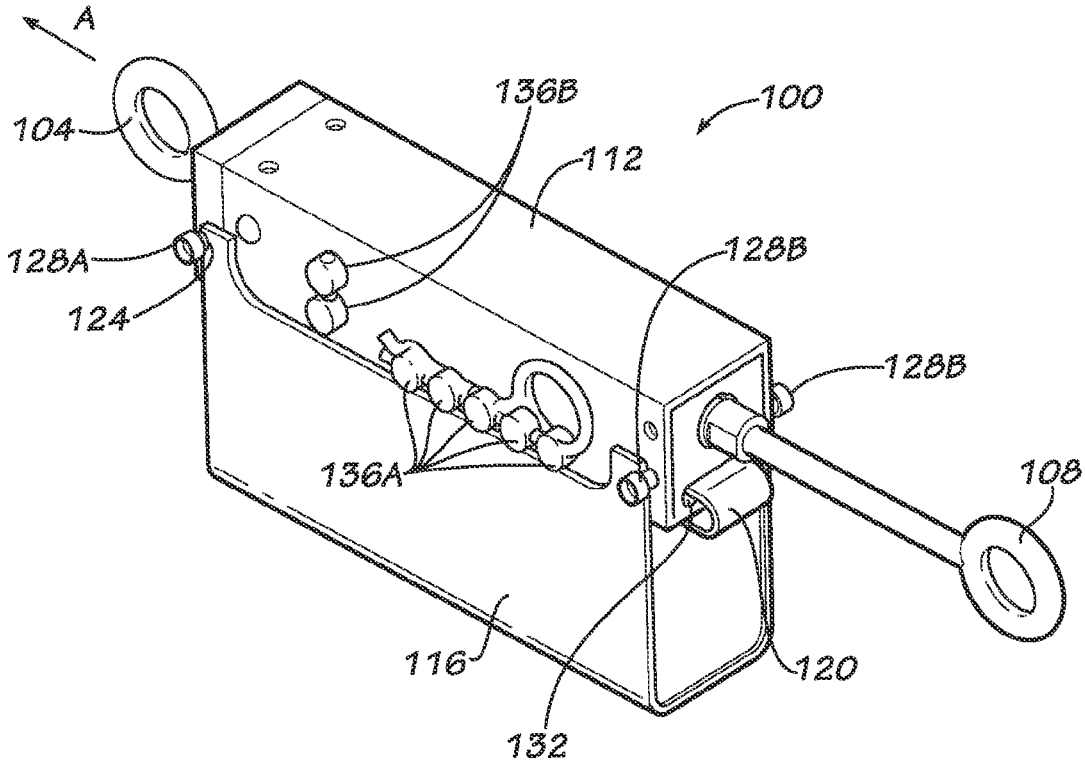
FIG. 5 is a perspective view of a transition zone controller useful as part of systems of the present invention.
Figure 6:
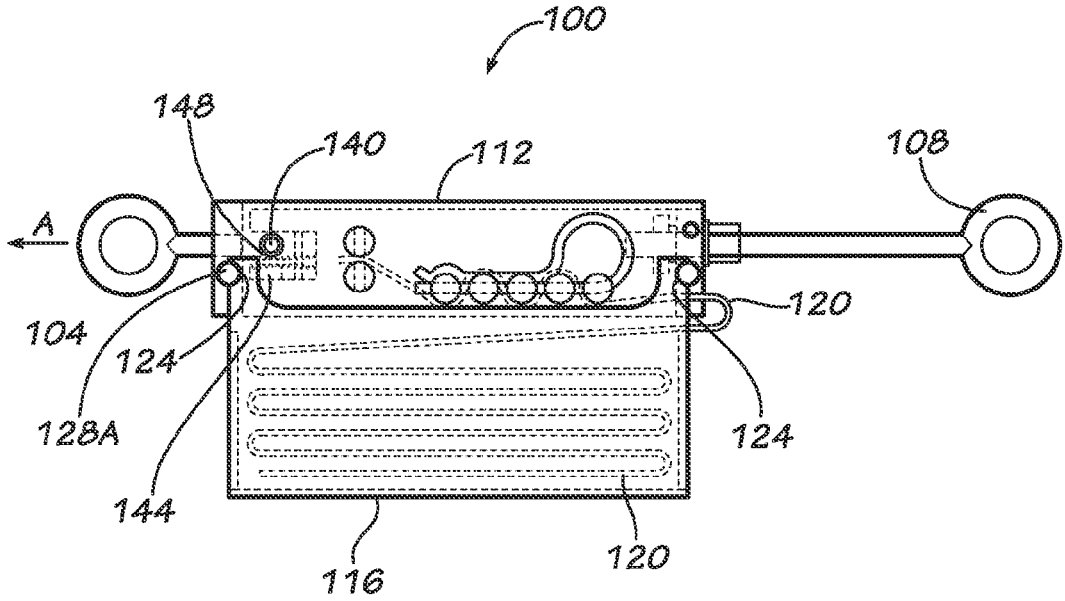
FIG. 6 is a side elevational view of the controller of FIG. 5 with portions of the internal structure shown in dotted lines.

Illustrated in FIGS. 5-6 is net deployment controller 100 useful as part of the present invention. Controller 100 functions to help shape a net, such as net 30, so that the net may form, or wrap, about the forwardmost portion of the to-be-arrested vehicle and facilitate its capture. Preferably two such controllers 100 will be used with each arresting system 10, one controller 100 cooperating with each stanchion 54.

Controller 100 may comprise eyebolts 104 and 108, housing 112, and tray 116. Contained within tray 116 is a length of pay-out tape 120, which preferably is (but need not necessarily be) made of nylon. Tray 116 further may include semi-circularly (or otherwise) shaped cut-outs 124 designed to receive bolts 128A-B or similar fasteners connecting the tray 116 to housing 112. As depicted in FIGS. 5-6, if bolts 128A move forward (in the direction of arrow A), because of the semi-circular shape of cut-outs 124 the bolts 128A will cease functioning to connect tray 116 to housing 112. When this connection no longer exists, tray 116 initially will pivot about bolts 128B and then simply fall away from housing 112 under force of gravity, freeing most of pay-out tape 120 for use.

Included as part of or within housing 112 may be slot 132, multiple friction pins 136A-B, shear pin 140, and grip plate 144. Tape 120 from tray 116 may be threaded into housing 112 through slot 132. The tape 120 then may, if desired, be threaded in serpentine manner through a series of friction pins 136A and linearly through opposed friction pins 136B to provide resistance to its movement through housing 112. Leading edge 148 of tape 120 is connected to eyebolt 104 using grip plate 144 or any other suitable fastener.

When controller 100 is deployed, eyebolt 104 is connected (directly or indirectly) to a barrier such as net 30, while eyebolt 108 is connected (directly or indirectly) to a support such as stanchion 54. When a vehicle engages net 30, eyebolt 104 experiences force in the direction of arrow A causing shear pin 140 to fail in shear. As pin 140 shears, eyebolt 104 and housing 112 begin travelling in the direction of arrow A, releasing tray 116 and drawing tape 120 through friction pins 136A-B. This resistance to pay-out of tape 120 causes corners of net 30 to which controllers 100 are attached to remain tensioned through the early stage of the engagement, allowing the net 30 to form around the forwardmost portion of the vehicle to be arrested.

Figure 7:
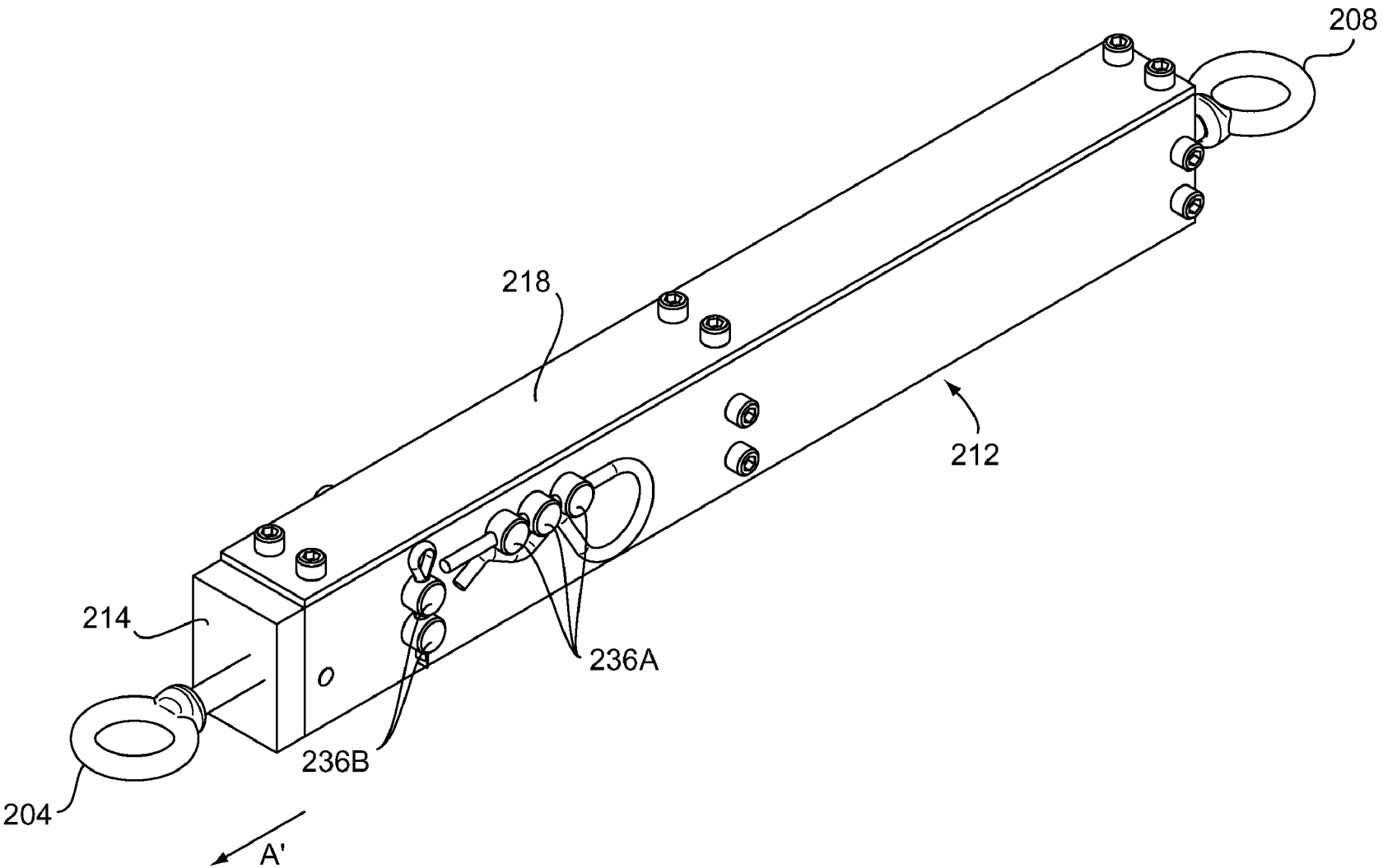
FIG. 7 is a perspective view of an alternate transition zone controller useful as part of systems of the present invention.
Figure 8:
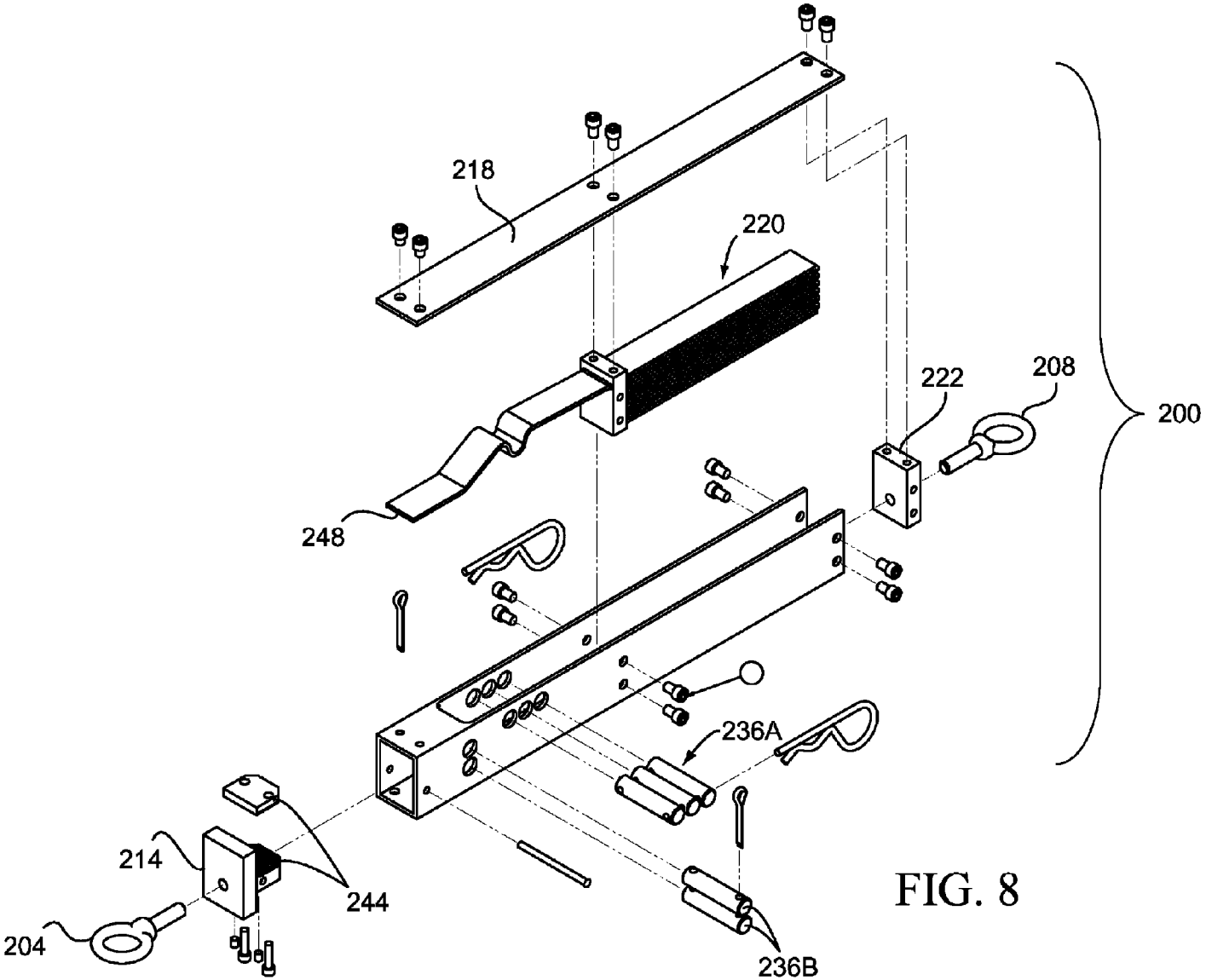
FIG. 8 is an exploded perspective view of the controller of FIG. 7.
Figure 9:
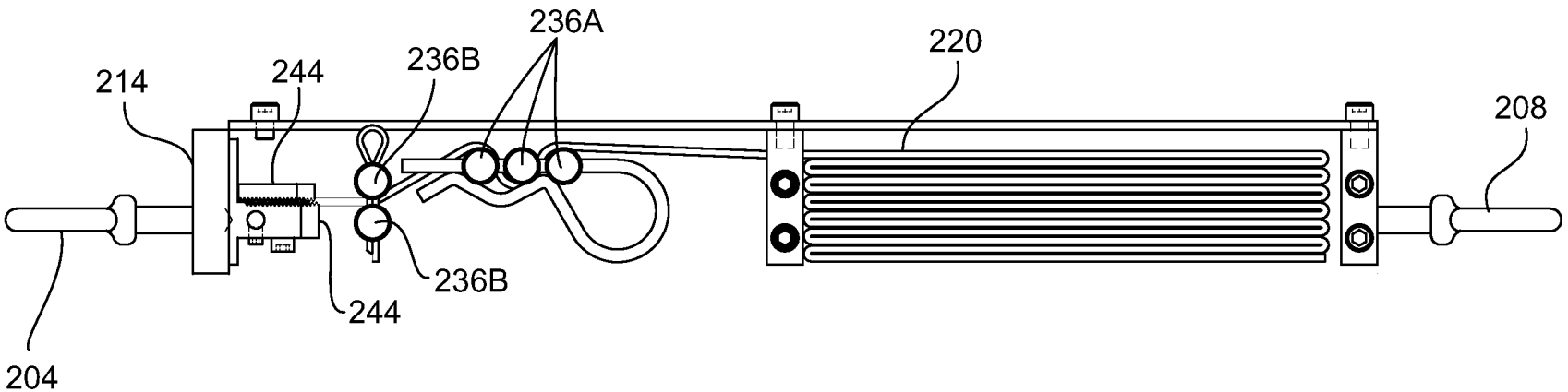
FIG. 9 is a partially cut-away view of portions of the controller of FIG. 7.

Shown in FIGS. 7-9 is an alternate net deployment controller 200. Controller 200 functions generally like controller 100 and may include eyebolts 204 and 208 and housing 212. Pay-out tape 220 may be contained within housing 212, with leading edge 248 of tape 220 connected to front cover 214 of the housing 212 using grip plates 244. Eyebolt 204 likewise is connected to front cover 214, so that movement of eyebolt 204 will effect movement of tape 220. Housing 212 additionally may, if desired, comprise top and rear covers 218 and 222, respectively.

Friction pins 236A-B and shear pin 240 also may form part of controller 200. Tape 220 typically is threaded through pins 236A-B in a manner similar to that described in connection with controller 100. Pins 236A-B thus provide resistance to movement of tape 220 within housing 212.

Upon deployment, eyebolt 204 is connected (directly or indirectly) to net 30 or another barrier, and eyebolt 208 is connected (directly or indirectly) to stanchion 54 or another support. When a vehicle engages net 30, eyebolt 204 experiences force in the direction of arrow A'. This force causes pin 240 to fail in shear, allowing eyebolt 204, front cover 214, and tape 220 to travel in the direction of arrow A', with pins 236A-B resisting (but not preventing) this movement. The resulting effect of this resisted travel is that the corners of net 30 to which controllers 200 are attached remain tensioned through the early stage of engagement, allowing the net 30 to form around the to-be-arrested vehicle.

Figure 10:
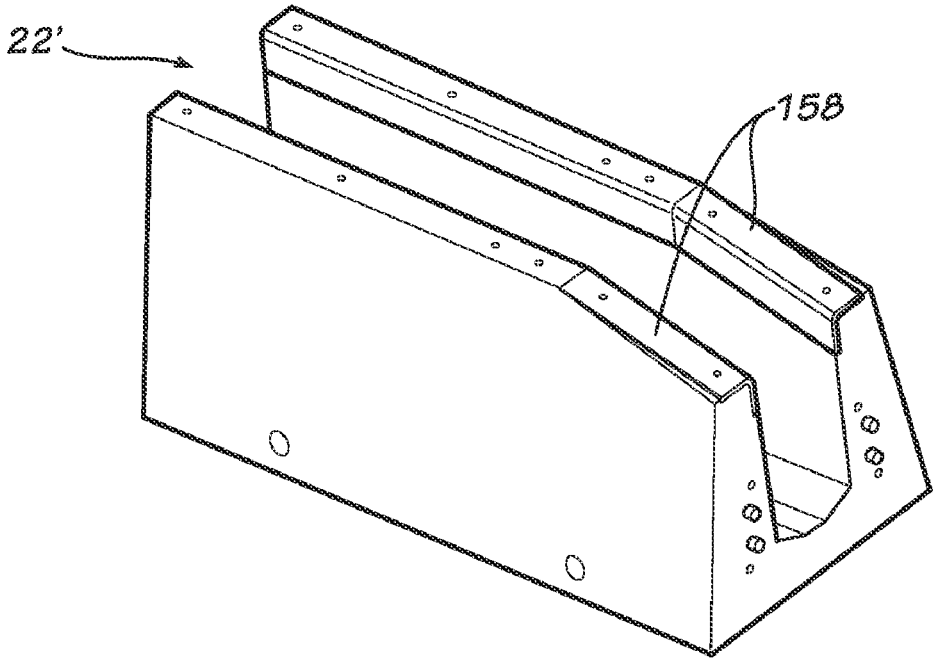
FIG. 10 is an isometric view of an exemplary beam section useful as part of systems of the present invention.
Figure 11:
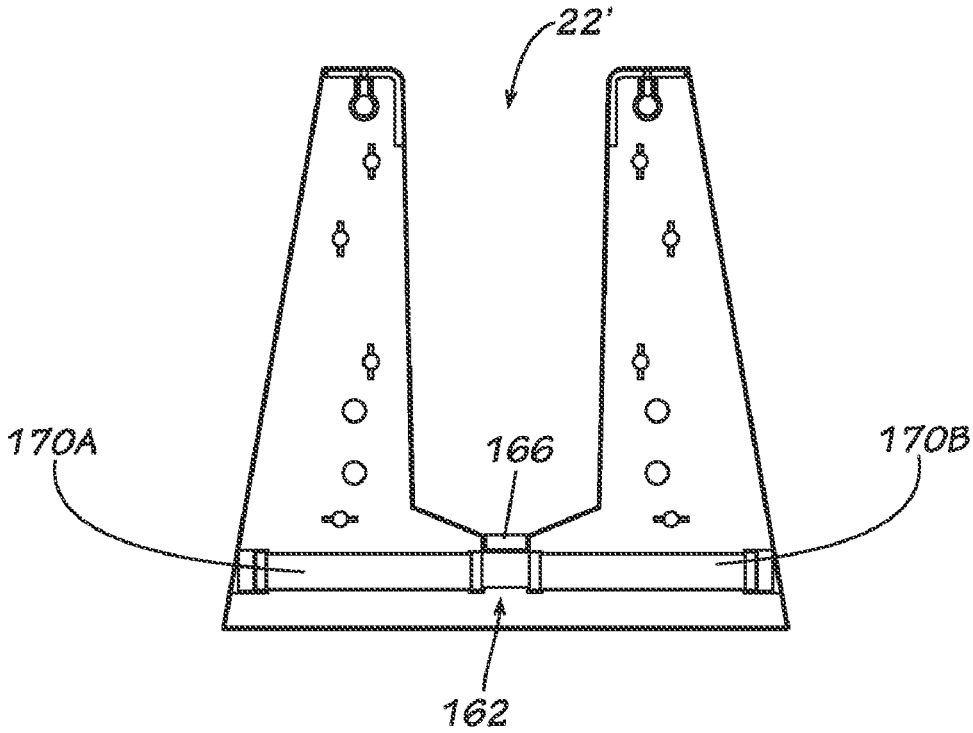
FIG. 11 is an end elevational view of the section of FIG. 10.
Figure 12:
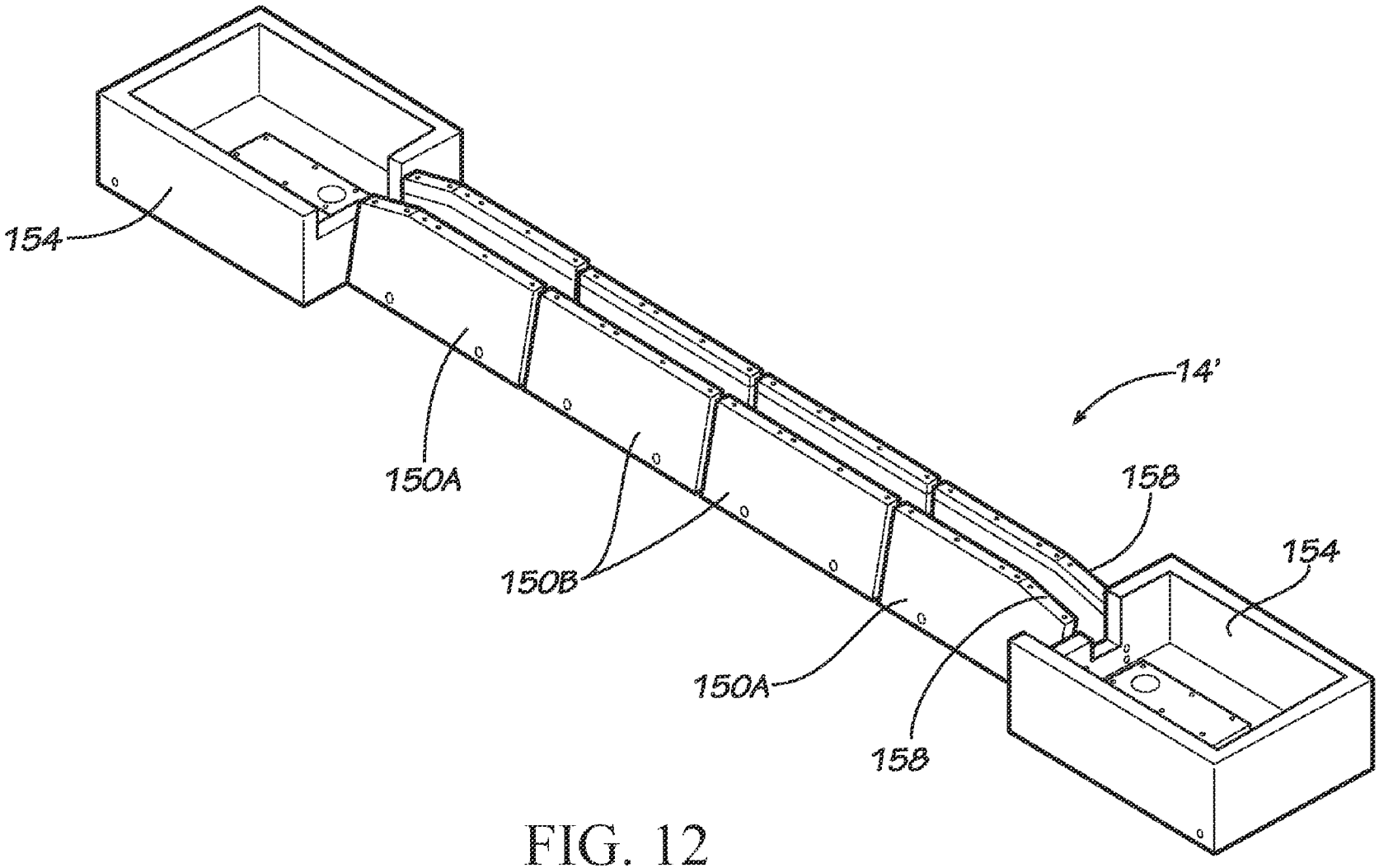
FIG. 12 is a perspective view of a laterally-slotted beam useful as part of systems of the present invention, the beam comprising sections such as those of FIGS. 10-11.

FIGS. 10-12 depict aspects of an alternate module 14' of the invention. Module 14' may comprise multiple sections 150A-B formed typically, although not necessarily, of precast concrete. Utilizing multiple sections 150A-B instead of a single beam allows more precise accommodation of differing roadway widths and crowns. Terminal sections 150A adjacent equipment pits 154 additionally may, if desired, have sloping upper surfaces 158 providing clearance for sweeping of tape 120 when a net is engaged.

Any or all of sections 150A-B may contain conduit 162 therein. Conduit 162 communicates with slot 22', as shown in FIG. 10, so as to drain fluids (such as water) from module 14' to the exteriors of sections 150A-B. In the version depicted in FIG. 10, conduit 162 is shaped as an inverted "T," with fluid draining initially into generally vertical component 166 and thence into either or both of generally horizontal components 170A-B.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A net deployment controller comprising:

a. a housing having a first portion and a second portion;

b. means for connecting the first portion of the housing to a net;

c. means for connecting the second portion of the housing to a support;

d. pay-out tape contained within the housing and connected to the first portion connecting means;

e. means, through which the pay-out tape is threaded, for resisting, but not preventing, removal of the pay-out tape from the housing; and f. a shear pin which, after shearing, allows the pay-out tape to start to be removed from the housing as an effect of movement of the first portion connecting means.

2. A controller according to claim 1 in which the resisting means comprises:

a. a first plurality of friction pins through which the pay-out tape is threaded in serpentine manner; and b. a second plurality of friction pins through which the pay-out tape is threaded linearly.

3. A controller according to claim 2 in which the friction pins of the first plurality are generally aligned along a first axis and the friction pins of the second plurality are aligned along a second axis generally perpendicular to the first axis.

4. A controller according to claim 3 in which the pay-out tape has a leading edge and the first portion connecting means comprises a grip plate to which the leading edge is connected.

5. A controller according to claim 4 in which the housing has a front cover to which the grip plate is connected.

6. A system for impeding movement of an object travelling in a path along a travel surface, the system comprising:

a. a barrier having at least a portion positioned either below the travel surface or sufficiently above the travel surface so as not to intersect the path;

b. means for repositioning the barrier so as to intersect the path; and c. a controller connected directly or indirectly to both the barrier and the repositioning means, the controller comprising:

i. pay-out tape;

ii. a housing for receiving the pay-out tape;

iii. a plurality of friction pins through which the first portion of the pay-out tape is threaded; and iv. a shear pin which, after shearing, allows the pay-out tape to start to be removed from the housing.

7. A system according to claim 6 further comprising:

a. a first eyebolt connecting the housing to the barrier; and b. a second eyebolt connecting the housing to the repositioning means.

8. A system according to claim 7 in which the first portion of the pay-out tape is connected to the first eyebolt.

9. A system according to claim 8 further comprising a slotted beam into which the barrier fits prior to being repositioned to intersect the path, the beam comprising a plurality of sections of pre-cast material.

10. A system according to claim 9 in which at least one of the sections has means, comprising an angled upper surface, for providing sweep clearance for the pay-out tape.

11. A system according to claim 9 in which at least one of the sections includes conduit communicating with the slot so as to drain liquid therefrom.

12. A system according to claim 10 in which at least one of the sections includes conduit communicating with the slot so as to drain liquid therefrom.

13. A system according to claim 6 in which the object is an aircraft.

14. A system according to claim 6 in which the object is a ground-based vehicle.

* * * * *